United States Patent [19]

Gardner, Sr.

[11] 4,418,840

[45] Dec. 6, 1983

[54] AUTOMATIC TOOTHPASTE DISPENSER

[76] Inventor: David P. Gardner, Sr., Box 1927, Parksville, B.C., Canada, V0R 2S0

[21] Appl. No.: 236,851

[22] Filed: Feb. 23, 1981

[51] Int. Cl.[3] ..... B65D 35/28; B65G 27/18

[52] U.S. Cl. ..... 222/96; 222/102; 222/161; 222/185; 141/360

[58] Field of Search ..... 222/92, 95, 96, 101, 222/102, 105, 160, 161, 196; 401/4, 145, 146; 141/351, 360, 361, 362

[56] References Cited

U.S. PATENT DOCUMENTS

| | | | |
|---|---|---|---|
| 1,841,275 | 1/1932 | Baptiste | 141/362 X |
| 2,079,364 | 5/1937 | Stewart | 222/161 |
| 2,580,899 | 1/1952 | Eaton | 222/161 |
| 2,684,183 | 7/1954 | Werner . | |
| 2,689,066 | 9/1954 | Budnik . | |
| 2,726,016 | 12/1955 | Anderson, Jr. . | |
| 2,837,243 | 6/1958 | Zebnik | 222/101 |
| 3,563,420 | 2/1971 | Ansley | 222/199 |
| 4,139,126 | 2/1979 | Krasner et al. | 222/504 X |
| 4,160,513 | 7/1979 | Cockerham . | |
| 4,203,567 | 5/1980 | Featherstone . | |

*Primary Examiner*—Joseph J. Rolla
*Assistant Examiner*—Michael S. Huppert
*Attorney, Agent, or Firm*—Klarquist, Sparkman, Campbell, Leigh & Whinston

[57] ABSTRACT

This invention is directed to a dispenser for housing and dispensing on demand a predetermined amount of the semi-fluid contents of a compressible tube container, such as a toothpaste tube. The dispenser for automatically dispensing a semi-fluid material that can be caused to flow slowly from a compressible tube comprises:

(a) a structure for holding the tube in a position such that the opening in the tube extends downwardly;

(b) an arrangement for slidably closing the end of the opening in the tube;

(c) a device for agitating upon manual command the tube and semi-fluid contents such that the contents are induced to flow;

(d) the above recited arrangement withdrawing the slidable closure from the opening upon manual command to thereby permit the material to flow gradually out of the tube.

8 Claims, 4 Drawing Figures

AUTOMATIC TOOTHPASTE DISPENSER

FIELD OF THE INVENTION

This invention is directed to a device that can be activated on demand for dispensing in a predetermined amount the semi-fluid contents of a capped tube, such as toothpaste from a toothpaste tube.

BACKGROUND OF THE INVENTION

For many years, there has been a continuing need by persons who are manually handicapped for an invention that can dispense the contents of containers and the like that are commonly available in the marketplace. For example, a person who has lost a hand or an arm through amputation or through paralysis has a very difficult time performing seemingly simple everyday tasks and personal hygiene procedures such as squeezing toothpaste from a toothpaste tube onto the bristles of a toothbrush.

The following listed patents disclose different types of dispensers.

1. U.S. Pat. No. 2,580,899 Eaton
2. U.S. Pat. No. 2,684,183 Werner
3. U.S. Pat. No. 2,689,066 Budnik
4. U.S. Pat. No. 2,726,016 Anderson
5. U.S. Pat. No. 4,160,513 Cockerham
6. U.S. Pat. No. 4,203,567 Featherstone Eaton discloses an actuator 20 for raising and lowering support 14 in which the material to be dispensed is situated. However, the device is suitable only for tooth powder and requires manual agitation and manipulation.

Werner discloses a dentifrice dispenser having a valve actuating bar 30, sliding valve plate 32 and a recess 33 in actuating bar 30. The recess 33 receives a toothbrush and upon the application of pressure inwardly upon bar 30 by the toothbrush, plate 32 is opened and toothpaste is dispensed. However, this device requires a change from a toothpaste tube to some other type of container. The device is also complicated and cannot be managed by a handicapped person.

Budnik discloses a dispensing holder for paste tubes having suction cups 23 for attachment to a vertical surface. This device is not suitable for handicapped persons because it is manually operated.

Anderson discloses a paste materials dispensing device which utilizes a hollow rectangular main slide 34, in which a toothbrush is inserted. The device is manually operated and requires a significant amount of manual pressure to operate it.

Cockerham discloses a toothpaste dispenser having a slidable spring loaded gate-valve 26 which, when in the closed position, blocks the flow of toothpaste. This device is not suitable for use by handicapped persons as it is manually operated.

Featherstone is of general interest only. Featherstone requires hand pressure rather than a mechanical agitator.

SUMMARY OF THE INVENTION

I have invented a semi-fluid materials dispenser suitable for use by handicapped persons. The dispenser readily dispenses the contents of a toothpaste tube in measured quantities by inserting the bristled end of a toothbrush into the device to thereby activate it into dispensing paste onto the bristles of the brush.

The dispenser is proposed primarily to aid those who are handicapped by the loss of the use of one hand, or who have impaired vision, but by its very nature, would be an asset to every household for the dispensation of toothpaste in a sanitary and thrifty manner. Those who suffer from arthritis of the hands would also find the invention useful.

The toothpaste dispenser I have invented is electrically operated, can be loaded and used by persons who are feeble, or suffer from impaired vision, or have lost the use of one hand (either left or right hand), requires little or no strength to use or operate, accommodates any of the regular sizes of toothpaste tubes, 50 ml., 100 ml., is sanitary to use, conserves toothpaste and has a pleasing appearance to the eye. Furthermore, should a power failure occur, the tube of paste can be easily removed from the dispenser and used in the conventional manner.

The components of the dispenser can be readily disassembled, cleaned for hygiene purposes and re-assembled.

The invention is directed to a dispenser for automatically dispensing a semi-fluid material that can be caused to flow slowly from a compressible tube, wherein there are:

(a) means for holding the tube in a position such that its opening or outlet is directed downwardly so that gravity acts upon the semi-fluid material urging it toward the outlet;
(b) means for slidably closing the opening or outlet;
(c) means for agitating upon manual command the tube and semi-fluid contents such that the contents are induced to flow;
(d) means for withdrawing the slidable closing means from the opening upon manual command to thereby permit the material to flow gradually out of the tube.

The invention also contemplates a dispenser wherein the slidable closing means are electrically operated;

and wherein the agitation means is an electrical motor which provides agitation by means of an eccentrically mounted drive bar;

and wherein the means for withdrawing the slidable closing means is an electrically operated solenoid;

and wherein the solenoid is activated by means of an electrical switch which is turned on by contact with an object inserted under the opening in the tube;

and wherein there are a pair of parallel caged rollers on the opposite sides of the upper end of the tube, and under the influence of gravity urge the contents to flow from the tube and concurrently therewith to roll down either side of the tube as the semi-fluid contents of the tube are dispensed;

wherein there is a receptacle for receiving the bristle end of a toothbrush; and gate means mounted on the front of the dispenser for enabling the toothbrush to be inserted into the dispenser.

DRAWINGS

DETAILED DESCRIPTION OF AN EMBODIMENT OF THE INVENTION

Figure 1:
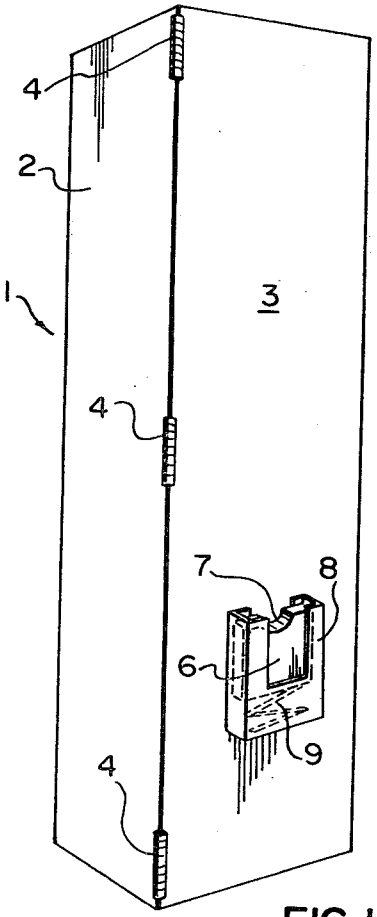
FIG. 1 represents a perspective view of the front of the automatic toothpaste dispenser.

Referring to FIG. 1, the dispenser 1 is constructed basically of a vertically elongated box-like housing 2 with a hinged front door 3. The door 3 is supported by hinges 4, which permit the door to be opened and closed. The door 3 is secured to the housing 2 by a catch 5.

On the front of the door 3, in the lower area, is located a sliding gate 6, with a brush rest groove 7 on the top, mounted in a gate track 8. The gate 6 is mounted above a compression coil spring 9 which permits the gate 6 to be depressed downwardly in the track 8 but upon release returns the gate 6 to original level.

Figure 2:
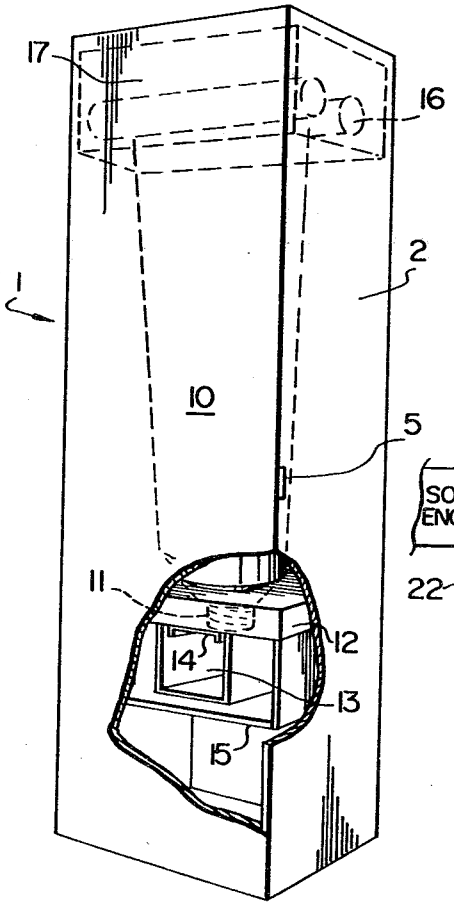
FIG. 2 represents a cut-away frontal perspective view of the interior of the automatic toothpaste dispenser.

FIG. 2 depicts the internal design of the dispenser 1. A toothpaste tube 10 is inverted within the housing 2. The neck 11 fits within a tube collar receiving plate 12. Fitted under the central area of the plate 12 is a brush pocket 13. This is sized to receive the bristle end of a conventional toothbrush (not shown). A metering bar 14 is mounted under the tube collar receiving plate 12 and determines the quantity of toothpaste that is poured on the bristles of the brush. An agitator thrust yoke 15 is positioned below and connects to the plate 12. A space below the yoke 15 is provided for the electrical agitator device (not shown). The agitator can be any suitable conventional mechanism for vibrating or oscillating the agitator yoke 15 such as for example a small electric motor which causes agitation by means of an eccentrically mounted drive bar.

The crimped and folded end of the toothpaste tube 10 (as seen in FIG. 2) fits within a pair of parallel rollers 16, which are mounted in a cage 17, the entire unit being capable of movement upwardly and downwardly within the interior space of the housing 2. Thus, when installing a new tube of toothpaste 10 in the dispenser 1, one first fits the crimped, folded end of the tube 10 between the parallel rollers 16 (the roller cage 17 is held by one hand in its uppermost position), then removes the cap of the tube 10, and then moves the tube 16 up slightly in the rollers 16 in order to allow the neck 11 of the tube 10 to settle into the receptacle of the tube collar receiving plate 12. The metering bar 14 holds the paste in the tube 10 until it is ready to be used.

Figure 3:
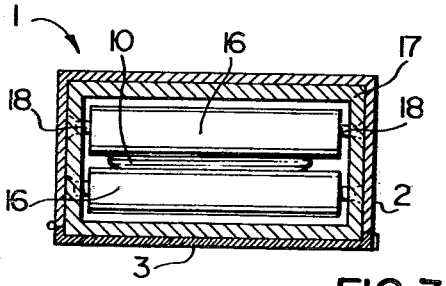
FIG. 3 represents a cut-away top view of the interior of the automatic toothpaste dispenser.

FIG. 3 represents a cut-away top view of the dispenser 1 with the crimped end of the tube 10 installed in place between the rollers 16. The rollers 16 are rotatably set in the roller cage 17 by means of four spindles 18 that are aligned with the respective axis of the two rollers 16.

The two rollers are constructed of a heavy material such as steel, stainless steel, plated iron, and the like, and roll down either side of the tube 10 as toothpaste from the interior of the tube 10 is dispensed. The rollers 16 must be constructed of a material that is sufficiently heavy to move downwardly under the influence of gravity on either side of the tube 10 as the tube 10 is agitated to aid in dispensing toothpaste. The door 3 is positioned on the front of the housing 2 and overlaps the front edges of the two sides of the housing 2, for ornamental purposes. It will be appreciated that a design of housing and door other than those shown in the drawings can be made to accommodate esthetic tastes.

Figure 4:
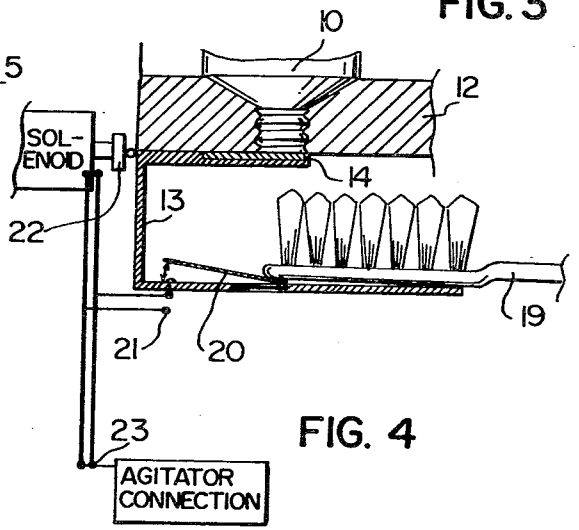
FIG. 4 represents a cut-away side view of the dispensing mechanism of the automatic toothpaste dispenser.

FIG. 4 demonstrates in detail by means of a cut-away side view the manner in which the bristle end of a toothbrush 19 fits within brush pocket 13 and engages with a brush spring 20, depressing the latter, which in turn by means of electrical contacts 21 activates a solenoid 22. The solenoid 22 upon activation withdraws the metering bar 14 a predetermined distance to permit paste to be dispensed onto the bristles of the brush 19. The dimensions of the metering bar 14 and yoke 15 are such that the mid-point of the bristles of most conventional toothbrushes on the market will be positioned directly under the opening in the tube 10.

Depression of the spring 20 by the brush 19 will also activate the agitator (not shown) by means of electrical contacts 23, which are electrically connected to the electrical agitator.

To use the dispenser, the toothbrush 19 is held with bristles up and placed on the brush rest 7 of sliding gate 6. The gate 6 is pressed down gently to open it. The brush 19 is then pushed forward under the paste metering bar 14 which is located in the brush pocket 13. When the paste metering bar 14 reaches the end of its travel when pulled back by the solenoid 22, the tube is open, and the agitator power source is engaged thereby causing the agitator to vibrate the tube 10 via the agitator thrust extension yoke 15 to the tube collar receiving plate 12.

The agitator action is powered upwardly only; the return travel downwardly is effected by gravity assisted by the weight of the roller cage assembly.

When pressure by the brush 19 is released, the power source is interrupted and the paste metering bar 14 closes over the tube end, thereby stopping the flow of toothpaste. Removal of the brush 19 allows the gate 6 to close.

When sufficient paste has been dispensed onto the brush 19, the user simply withdraws the brush 19 from the brush pocket 13. Withdrawal of the brush 19 releases spring 20 which deactivates the solenoid 22. The metering bar 14 then closes (by means of springs which are not shown) over the open end of the toothpaste tube 10. The paste laden brush 19 is withdrawn through gate 6, which then springs upwardly to its closed position as seen in FIG. 1.

The previous description indicates that the paste tube neck, with the tube cap removed, can be inserted without any holding action in the receiving hole in the tube collar receiving plate. It is possible as an alternative embodiment, however, that the receiving hole can be threaded to correspond to the threads of the tube neck. The neck of the tube can thus be screwed into the hole. This ensures that the agitator cannot "kick" the tube out of place. While this embodiment complicates the operation of the dispenser somewhat, the overall effect can be beneficial in appropriate situations.

When performing the actual act of applying toothpaste to the bristles of the brush, the instructions are to push the brush forward against the paste metering bar 14. This action requires some strength, even though it is minimal. It may thus be too much for the very feeble. Consequently, the activation procedure can be designed to be electrical. In that case, the instructions should read "Push brush into pocket to fullest extent", or some similar wording. The results are the same, but the manual effort is minimized. Also, the action of the metering bar is much quicker, both in opening and closing the opening to the tube neck. This ensures a neater application of paste at the correct location on the bristles of the brush.

A further embodiment can be used in cold environments. When the device is used in temperatures considerably lower than average room temperature, the tube collar receiving plate 12 can be heated with a small electrical resistor protected element. This heat provides correct viscosity of toothpaste to ensure that it runs readily out of the tube.

The dispenser mechanism is preferably housed in an oblong case measuring internally approximately $11\frac{1}{2}$ inches in height, by $2\frac{1}{2}$ inches in width, by $1\frac{7}{8}$ inches in depth. Outside dimensions will be covered by the thickness of material chosen for construction of the dispenser.

The length of the case has been selected to accommodate the three most popular commercial sizes of toothpaste tubes - 50 ml., 100 ml. and 150 ml. The dispenser can, of course, be reduced in length in accordance with the size of the agitator available.

It is suggested that the dispenser be connected to and powered by voltage similar to that which powers a conventional bathroom outlet. If more voltage is required, it may be necessary to make available an electrical power source for which the back of the dispenser case would act as the electrical source outlet cover. In any event, the dispenser is designed to be fastened to a wall or counter back at a convenient level for those who will use it. Dry cell power is possible as an alternative power source.

The function of the dispenser is based upon the principle that, due to the viscosity of most commercially available tubed toothpastes, if the tube is held upside down with the cap removed for a short while and the paste is at about room temperature, the paste will gradually run out. Slight agitation will assist this natural flow of the toothpaste to the extent that it will adequately fill the bristles of a brush in a very short time. The dispensation of toothpaste from the tube is encouraged by the two heavy rollers which roll down either side of the toothpaste tube as the toothpaste is dispensed from the tube under agitation.

As some users would wish to carry a dispenser with them on a journey away from home, the case can be equipped with at least two types of wall fasteners, for example, screws and suction cups. The screws serve as permanent types of fasteners in the home bathroom while the suction cups can be used for travelling. The suction cups can be used on smooth surfaces such as mirrors, and the like.

Due to the possibility of preference for a less bulky dispenser, particularly by women, the dimensions can be graduated to accommodate the smallest paste tube and to range upwardly to larger commercial sizes.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A dispenser for automatically dispensing semi-fluid material from a compressible tube having an outlet in the form of an opening, comprising:

(a) means for holding the tube with the outlet directed downwardly so that gravity urges the contents to move toward the outlet;

(b) a slidable closure for the opening in the tube;

(c) agitating means for agitating the tube and semi-fluid contents to induce the contents to flow from the tube outlet when the outlet is open;

(d) means operable when actuated for withdrawing the slidable closure from the opening and to initiate operation of said agitating means to agitate the tube and contents and thereby effect flow of the contents from the tube;

(e) the tube holding means (a) comprising a pair of parallel rollers which between them hold the end of the tube opposite end and upon agitation are caused to roll under the influence of gravity down either side of the tube to aid in dispensing the semi-fluid contents of the tube; and (f) an opening receiving collar which holds therein the open end of the tube.

2. The dispenser of claim 1 wherein the agitation means (a) and the means for withdrawing the slidable closure (d) are electrically operated.

3. The dispenser of claim 2 wherein the agitation means (a) is an electrical motor which provides agitation by means of an eccentrically mounted drive bar.

4. The dispenser of claim 2 wherein the means for withdrawing the slidable closure (d) is an electrically operated solenoid.

5. The dispenser of claim 4 wherein the solenoid is activated by means of an electrical switch which is turned on by contact with an object inserted under the opening in the tube.

6. The dispenser of claim 5 wherein the solenoid and the motor are electrically activated by a switch which turns on when contacted with a toothbrush.

7. The dispenser of claim 1 wherein the dispenser additionally comprises:

(g) a receptacle positioned underneath the collar (f) suitable for receiving therein the bristle end of a toothbrush;

(h) means for connecting the collar (f) with the agitating means (c); and (i) gate means mounted on the front of the dispenser for enabling the toothbrush to be inserted into the dispenser.

8. The dispenser of claim 7 wherein the rollers are parallel and rotatably mounted within the housing of the dispenser by means of a cage which can be moved upwardly and downwardly within the housing.

* * * * *